US005113590A

United States Patent [19]

Shapiro et al.

[11] Patent Number: 5,113,590

[45] Date of Patent: May 19, 1992

[54] PROTRACTOR

[75] Inventors: Bruce Shapiro, Northbrook; Gunar Narubin, Chicago, both of Ill.

[73] Assignee: Creative Works L.P., Northbrook, Ill.

[21] Appl. No.: 716,963

[22] Filed: Jun. 18, 1991

[51] Int. Cl.[5] ..... B43L 7/10

[52] U.S. Cl. ..... 33/471; 33/403; 33/424; 33/495; 116/320

[58] Field of Search ..... 33/403, 421, 422, 424, 33/425, 426, 430, 431, 435, 465, 471, 472, 495, 496, 497, 498, 500; 116/320, 309, 319

[56] References Cited

U.S. PATENT DOCUMENTS

| | | | |
|---|---|---|---|
| 454,710 | 6/1891 | Brown | 33/431 |
| 1,022,849 | 4/1912 | Jasgott | 33/422 |
| 1,058,512 | 4/1913 | Aanstoots | 33/431 |
| 1,082,377 | 12/1913 | Ward | 33/424 |
| 1,087,751 | 2/1914 | Ferraris | 33/403 |
| 1,228,697 | 6/1917 | Ollariu | 33/431 |
| 1,849,575 | 3/1932 | Huber | 33/424 |
| 1,944,812 | 1/1934 | Sandell | 33/424 |
| 1,952,344 | 3/1934 | Webber | 33/495 |
| 2,001,654 | 5/1935 | Burrows | 33/424 |
| 4,731,933 | 3/1988 | Cope | 33/414 |

FOREIGN PATENT DOCUMENTS

| | | | |
|---|---|---|---|
| 99505 | 10/1898 | Fed. Rep. of Germany | 33/424 |
| 734659 | 4/1943 | Fed. Rep. of Germany | 33/424 |
| 998537 | 1/1952 | France | 33/471 |

*Primary Examiner*—Thomas B. Will

*Attorney, Agent, or Firm*—Dressler, Goldsmith, Shore, Sutker & Milnamow, Ltd.

[57] ABSTRACT

A protractor comprising a generally flat protractor disc having a straight edge portion and a semi-circular portion. An arm member is pivotally secured at one end to a central section of the straight edge portion and overlies the front surface of the semi-circular portion at the other end. The arm member has a straight drawing edge that aligns with angle indicia on the semi-circular portion. An arcuate member extends outwardly from the front surface of the semi-circular portion. The arm member has recess in a rear surface thereof that receives the arcuate member therein. The relationship between the depth of the recess and the distance that the arcuate member extends from the front surface of the semi-circular portion is such that the arm member is spaced from the indicia on the front surface.

5 Claims, 2 Drawing Sheets

14
12
16
32
30

14
16
38
32
12
36
34

10
12
14
20
22

16
22
30
32
14

16
20
32
14

PROTRACTOR

BACKGROUND OF THE INVENTION

This invention relates generally to a protractor and specifically to a protractor design to be used by school age children.

Protractors typically used by children in school comprise a generally flat protractor disc having a straight edge portion and a semi-circular portion having angle indicia on a front surface thereof. In order to draw a particular degree angle it is necessary to use the protractor to mark the apex of the angle and points associated with the legs of the angle. It is then necessary to manipulate the protractor to connect the points to form the particular angle. To measure the number of degrees of a particular angle, it is necessary to extend the lines forming the angle to coincide with the indicia on the protractor.

In U.S. Pat. No. 1,944,812 a protractor is disclosed that includes an arm member that may be pivotally located at various positions for the drawing of angular lines. The outer end portion of the arm member contacts an outer indicia surface of the protractor. This device is relatively complex in design and not particularly suitable for inexpensive manufacture from plastic components.

There is a need for a protractor that facilitates the drawing and measurement of angles and which may be inexpensively manufactured from plastic materials.

SUMMARY OF THE INVENTION

The protractor of the present invention comprises a generally flat protractor disc having a straight edge portion and a semi-circular portion that extends between the respective ends of the straight edge portion so as to define an open area or space therebetween. The semi-circular portion has angle indicia that extend outwardly from a front surface thereof. An arm member has a first end portion that is pivotally secured to a central portion of the straight edge portion and a second end portion that overlies the front surface of the semi-circular portion. The arm member has a straight drawing edge that aligns with the angle indicia and extends across the open area to form an angle with the straight edge portion.

In accordance with a unique aspect of the invention, an arcuate member extends outwardly from the front surface of the semi-circular portion. The arm member is provided with a recess formed in a rear surface thereof that is contoured to receive the arcuate member therein. The relationship between the depth of the recess and the distance that the arcuate member extends from the front surface of the semi-circular portion is such that the second end portion of the arm member is spaced from the indicia on the front surface. In so doing, movement of the arm member is facilitated and damage to the indicia is minimized.

The first end portion of the arm member has a rounded off-set portion extending from the straight drawing edge. The arm member is secured to the straight edge portion through a pivot pin that extends through the rounded off-set portion and the straight edge portion. The straight drawing edge is oriented with respect to the pivot pin such that a plane perpendicular . with the arm member extends along the straight drawing edge and through the pivot axis of the pivot pin.

All of the component parts of the compass are made of plastic material.

DESCRIPTION OF THE DRAWINGS

A preferred embodiment of the invention is illustrated in the accompanying drawings, in which.

DESCRIPTION OF A PREFERRED EMBODIMENT

Referring to FIGS. 1–7, a protractor constructed in accordance with the invention is indicated generally at 10. Protractor 10 comprises a protractor disc 12, an arm member 14 and an arcuate member 16.

Figure 1:
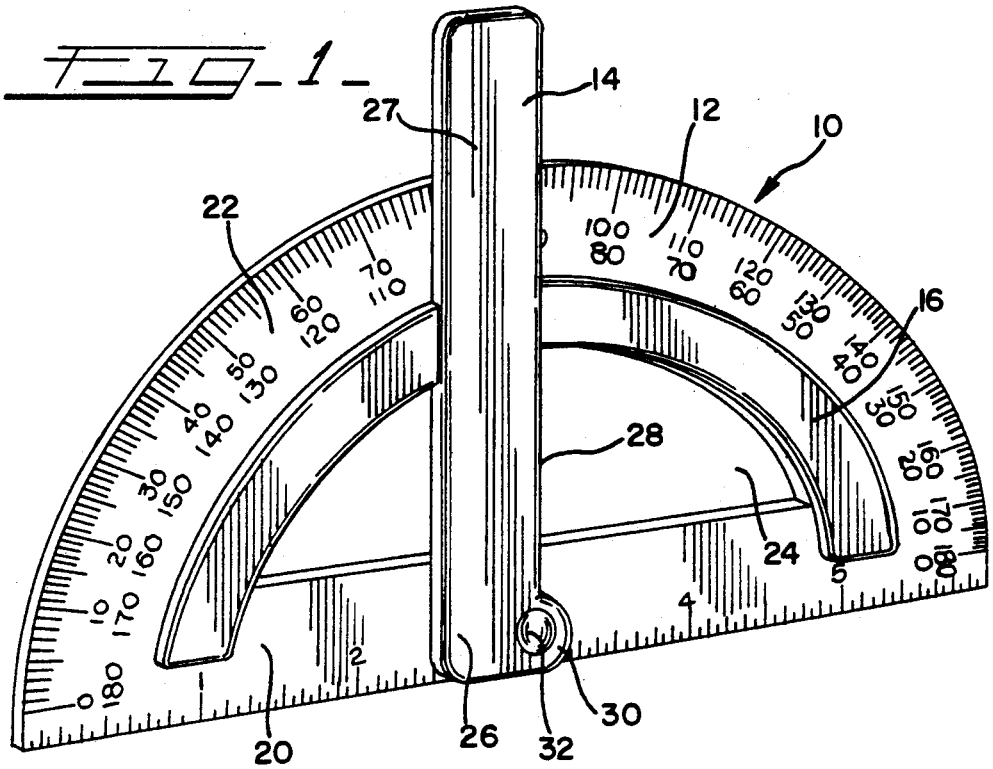
FIG. 1 is a perspective view of a protractor constructed in accordance with the invention.
Figure 2:
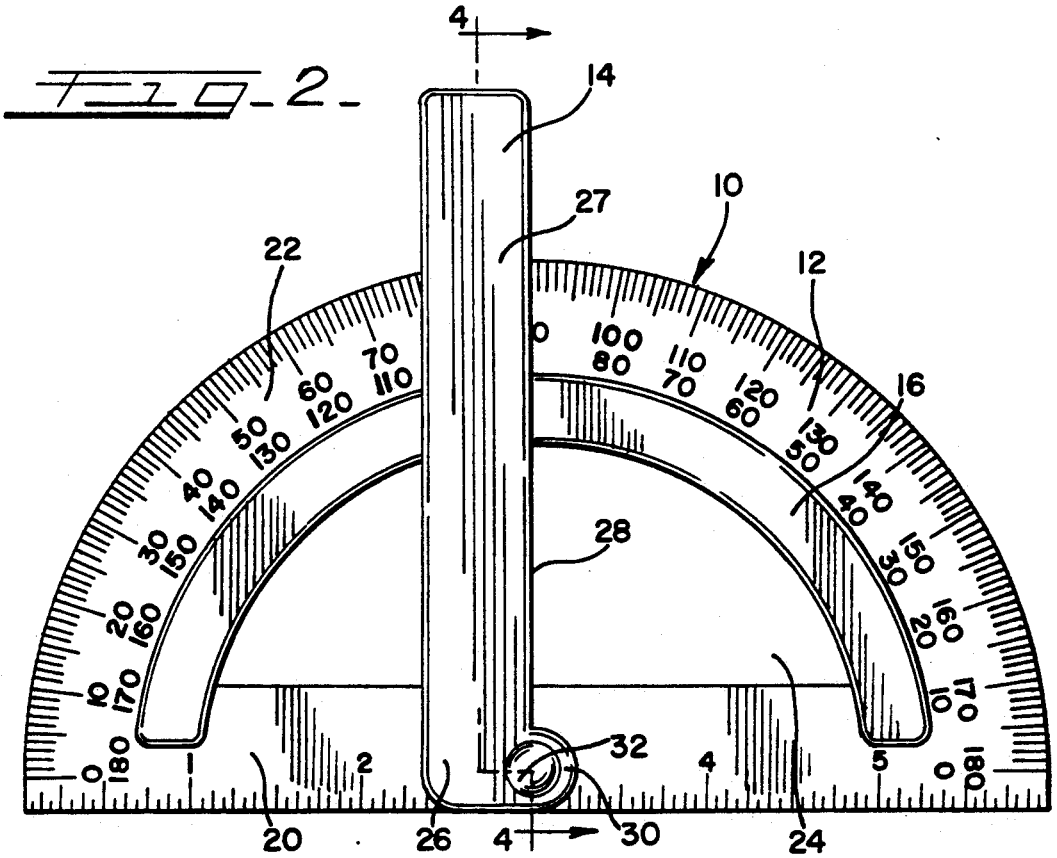
FIG. 2 is a front elevational view of the protractor shown in FIG. 1.

Protractor disc 12 comprises a straight edge portion 20 and a semi-circular portion 22. Straight edge portion 20 is preferably provided with typical ruler distance indicia formed on the front surface thereof. Semi-circular portion 22 extends between the respective ends of portion 20 so as to define a semi-circular open area or space 24 therebetween. Semi-circular portion is provided with typical protractor angle indicia formed on the front surface thereof as shown in FIGS. 1 and 2. Protractor disc 12 as described above is generally of the type typically used by school age children.

In accordance with the invention, arm member 14 has a first end portion 26 that is pivotally secured to a central section of straight edge portion 20. Arm member 14 has a second end portion 27 that overlies the front surface of semi-circular portion 22. Arm member 14 is formed with a straight drawing edge 28 that aligns with the angle indicia formed on semi-circular portion 22. The first end portion of arm member 22 is formed with a rounded off-set portion 30 extending from edge 28. Arm member 22 is pivotally secured to straight edge portion 20 by a pivot pin member 32 that suitably extends through off-set portion 30 and a central section of portion 20. Edge 28 is oriented with respect to pivot pin 32 such that a common plane perpendicular to arm member 14 extends through edge 28 and through the pivot axis of pivot pin 32.

Figures 3, 4, 5, 6, 7:
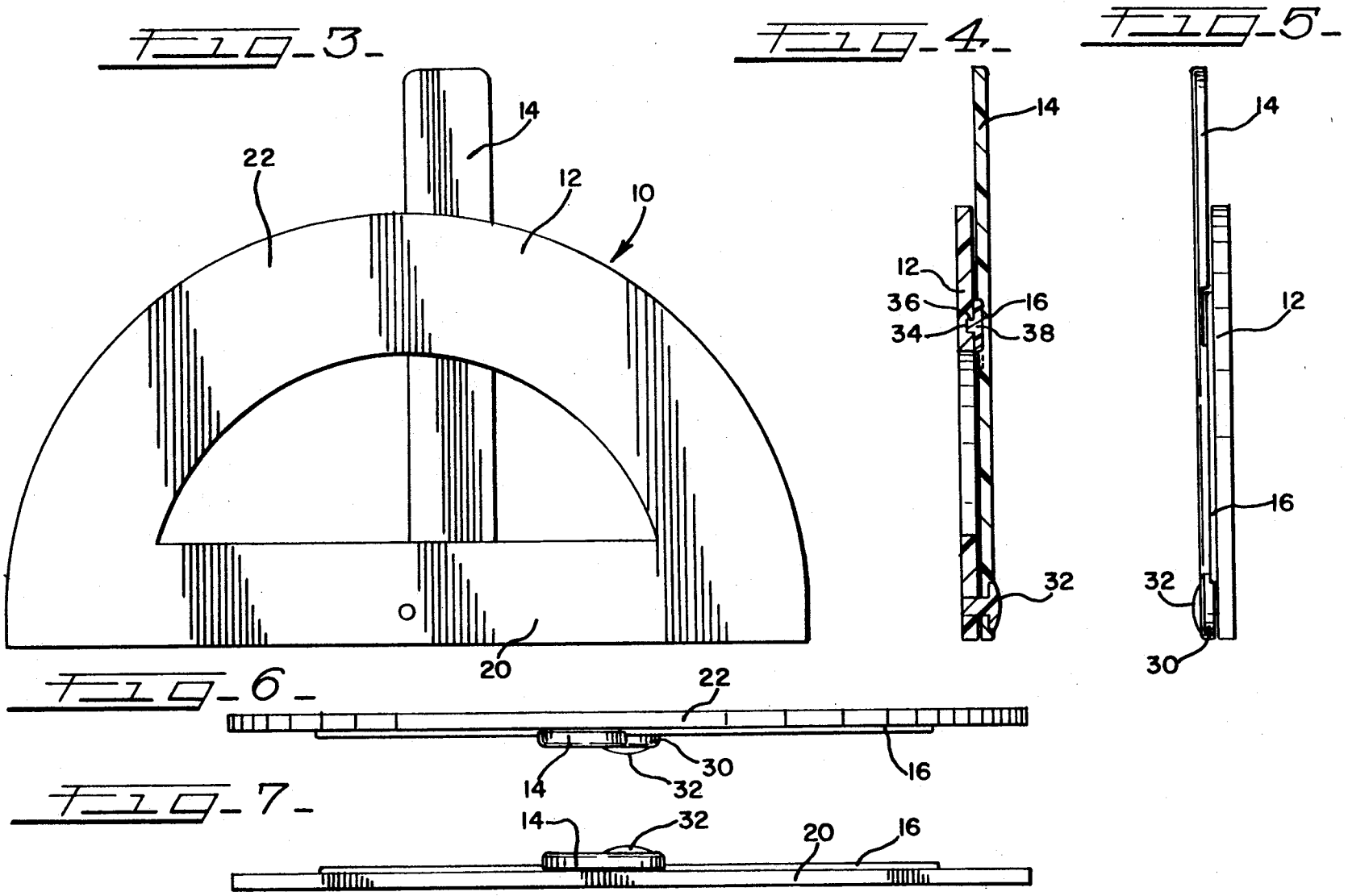
FIG. 3 is a rear elevational view of the protractor shown in FIG. 1.
FIG. 4 is a sectional view taken along line 4—4 in FIG. 2.
FIG. 5 is a side view of the protractor shown in FIG. 2.
FIG. 6 is a top plan view of the protractor shown in FIG. 2.
FIG. 7 is a bottom plane view of the protractor shown in FIG. 2.

An arcuate member 16 extends from the front surface of semi-circular portion 22, as best seen in FIGS. 1 and 2. Member 16 is suitably secured to portion 22 or may be integrally formed therewith. Referring to FIG. 4, in accordance with a preferred embodiment of the invention, the rear surface of member 16 is formed with an arcuate rib 34 that is received in a cooperating arcuate recess 36 formed in the front surface of portion 22. Member 16 is attached to portion 22 by a suitable adhesive or by ultrasonic welding.

The rear surface of arm member 14 is formed with a recess 38 that cooperatively receives arcuate member 16 therein. As arm member 14 rotates about pivot pin 32, recess 38 follows along the length of member 16.

The indicia formed on semi-circular portion 22 preferably extend outwardly from the front surface thereof. The depth of recess 38 is preferably less than the distance that arcuate member 16 extends outwardly from the front surface of portion 22 so to maintain the rear surface of member 14 spaced from the front surface of portion 22 and the indicia that extend outwardly therefrom. In so doing, the pivotal movement of arm member 14 is facilitated and damage and wear to the indicia is minimized.

From the foregoing description taken in connection with the accompanying drawing, the construction and manner of using protractor 10 will be readily apparent. When it is desired to draw a desired angle, the edge 28 of arm member 14 is aligned with the indicia of the desired angle. The included angle between edge 28 and straight edge portion 20 may then be scribed within open area 24. When it is desired to measure a particular angle, the legs of the angle are aligned with edge 28 and the straight edge portion 20 and the edge 28 of the second end portion of arm member 14 intersects the indicia corresponding to the particular angle.

The invention is not limited to the preferred form of protractor herein shown and described but is intended to include alternative embodiments that come within the spirit and scope of the invention as set forth in the appended claims.

What is claimed is:

1. A protractor device for measuring and drawing angles, comprising: a generally flat disc having a straight edge portion and a semi-circular portion each having a front surface, said semi-circular portion extends between the respective ends of said straight edge portion so as to define an open area therebetween, said semi-circular portion having angle indicia provided on a first portion of the front surface thereof; an arm member having a first end portion pivotally secured to a central section of said straight edge portion and a second end portion that overlies the front surface of said semi-circular portion, said arm member having a straight drawing edge that aligns with said angle indicia and extends across said open area to form an angle with said straight edge portion; and an arcuate member extending outwardly from a second portion of the front surface of said semi-circular portion, said arm member having a recess formed in a rear surface thereof that receives said arcuate member therein so as to space said second end portion of said arm member from the first portion of the front surface of semi-circular portion during pivotal movement of said arm member.

2. The protractor device as defined in claim 1 wherein the depth of said recess is less than the distance said arcuate member extends outwardly from the front surface of said semi-circular portion.

3. The protractor device as defined in claim 2 wherein said angle indicia extend outwardly from the front surface of said semi-circular portion and said arcuate member maintains said second end portion of said arm member spaced form said angle indicia.

4. The protractor device as defined in claim 3 wherein the first end portion of said arm member has a rounded off-set portion extending from said straight drawing edge and said arm member is secured to said straight edge portion through a pivot pin extending through said rounded off-set portion.

5. The protractor as defined in claim 4 wherein a common place perpendicular to said arm member extends through said straight drawing edge and through the pivot axis of said pivot pin.

* * * * *